United States Patent [19]

Niver

[11] Patent Number: 5,066,007

[45] Date of Patent: Nov. 19, 1991

[54] DIFFERENTIAL BREAKAWAY BASKETBALL GOAL

[75] Inventor: Michael A. Niver, Waukesha, Wis.

[73] Assignee: Huffy Corporation, Waukesha, Wis.

[21] Appl. No.: 405,517

[22] Filed: Sep. 11, 1989

[51] Int. Cl.[5] ..... A63B 63/08

[52] U.S. Cl. ..... 273/1.5 R

[58] Field of Search ..... 273/1.5 R; 272/93

[56] References Cited

U.S. PATENT DOCUMENTS

| | | | |
|---|---|---|---|
| 3,795,396 | 3/1974 | Kropelnitski | 272/93 |
| 4,082,269 | 4/1978 | Hill | 273/1.5 R |
| 4,111,420 | 9/1978 | Tyner | 273/1.5 |
| 4,151,989 | 5/1979 | Dittrich | 273/1.5 |
| 4,194,734 | 3/1980 | Tyner | 273/1.5 |
| 4,348,022 | 9/1982 | O'Donnell | 273/1.5 |
| 4,365,802 | 12/1982 | Ehrat | 273/1.5 |
| 4,433,839 | 2/1984 | Simonseth | 273/1.5 |
| 4,438,923 | 3/1984 | Engle et al. | 273/1.5 |
| 4,441,709 | 4/1984 | Schroeder et al. | 273/1.5 |
| 4,465,277 | 8/1984 | Dittrich | 273/1.5 |
| 4,483,534 | 11/1984 | O'Donnell | 273/1.5 |
| 4,534,556 | 8/1985 | Estlund et al. | 273/1.5 |
| 4,575,079 | 3/1986 | De Faveri | 273/1.5 |
| 4,583,732 | 4/1986 | Allen | 273/1.5 |
| 4,676,503 | 6/1987 | Mahoney et al. | 273/1.5 |
| 4,846,469 | 7/1989 | Nye | 273/1.5 R |

OTHER PUBLICATIONS

Adams Plastics, Inc. advertising circular 1-1980.

Slam Dunk Rim, Inc. advertising circular, type 3, 4-1978.

*Primary Examiner*—Paul E. Shapiro

*Attorney, Agent, or Firm*—Michael, Best & Friedrich

[57] ABSTRACT

A breakaway basketball goal assembly (20) includes a first mounting plate (30) for stationary mounting to the front of the backboard (22) and a second mounting plate (42) pivotally mounted to the first mounting plate and rigidly connected to the rim (24). The rim can pivot up or down in response to respective up and down forces, with the required downward force being greater, to provide differential breakaway. Left and right pivoting are also provided, to afford four way pivoting. Strength-increasing walls 102, 104, 106 are provided for the first mounting plate to prevent bowing away from the backboard and additionally serve the function of providing a protective finger pinch shroud. A universal structure selectively provides a choice between breakaway and non-breakaway applications without changing the manufacturing operation producing the goal assembly, to reduce cost.

5 Claims, 4 Drawing Sheets

Fig. 9
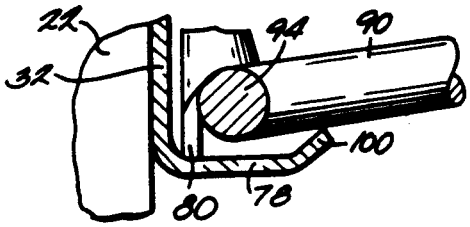
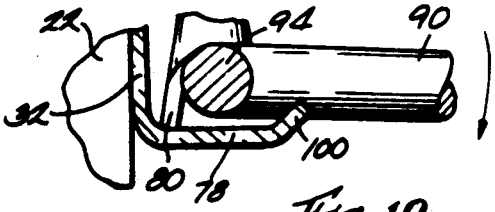
Fig. 10
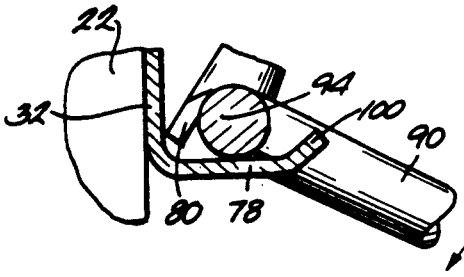
Fig. 11
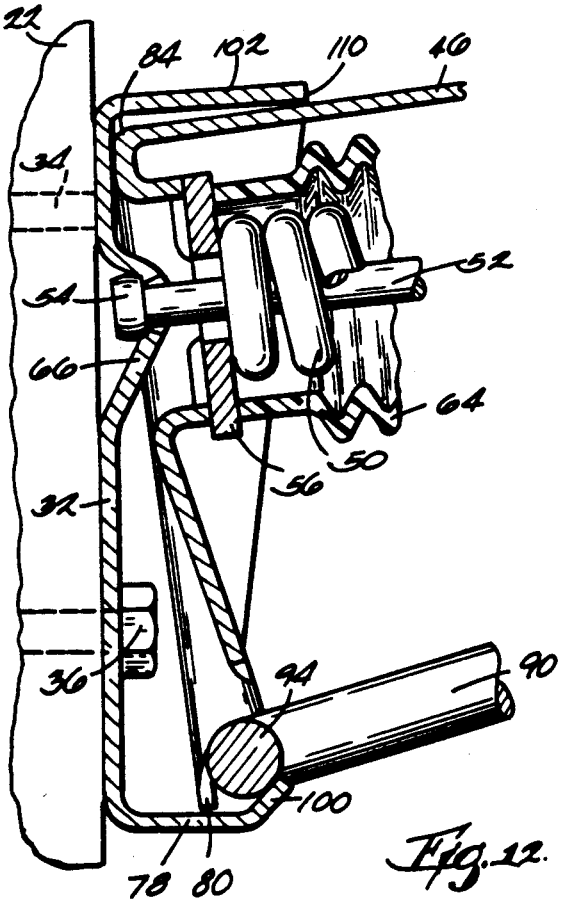
Fig. 12.

DIFFERENTIAL BREAKAWAY BASKETBALL GOAL

BACKGROUND AND SUMMARY

The invention arose during continuing development efforts in breakaway basketball goals, including that shown in U.S. Pat. No. 4,583,732, incorporated herein by reference.

Various basketball goal assemblies are known in the art which will give or breakaway in response to a given downward threshold force on the rim such as a slam dunk. The breakaway goal protects the player by absorbing energy in order to reduce wrist, hand and arm injuries. The backboard is also protected from breaking or shattering.

The present invention provides further protection to the player by additionally enabling the rim to breakaway, or pivot, upwardly, in the event the player hits the rim with his head or another part of his body during his upward jump.

The assembly of the present invention also provides differential breakaway forces, wherein the upward threshold force causing upward pivoting of the rim is less than the downward threshold force causing downward pivoting of the rim. The greater downward threshold force before the rim pivots retains a normal rebound characteristic. There is no need for such higher threshold force before the rim will pivot upwardly. The structure of the present assembly provides a reduced upward threshold force, to in turn provide greater safety for the player.

The invention further provides breakaway in four directions for further safety. The rim can pivot rightwardly to a rightward pivoted position in each of horizontal and upwardly and downwardly pivoted positions of the rim. The rim can also pivot leftwardly to a leftward pivoted position in each of the horizontal and upwardly and downwardly pivoted positions of the rim.

In a further aspect of the invention, a backplate is provided with strength-increasing structure to prevent bowing of the backplate away from the backboard upon a slam dunk. The backplate includes a structural rib at its top in the form of a generally horizontally planar portion extending forwardly which in combination with forwardly extending sidewalls serves the additional function of covering the gap between the backplate and a forward mounting plate when the rim is pivoted downwardly, to prevent a player from pinching his fingers in such gap, without requiring the provision of a separate additional protective pinch gap shroud such as shown at 58 in incorporated U.S. Pat. No. 4,583,732.

In another aspect, the invention provides a universal basketball goal assembly selectively providing a choice between a breakaway basketball goal and a non-breakaway basketball goal, without changing the manufacturing operation producing the goal assembly. The invention enables universal parts to be produced on an assembly line, without special operations, for example coining as in incorporated U.S. Pat. No. 4,583,732, for those goals which are to be breakaway goals. Instead, a single goal assembly line is run through the factory, and designated components are merely added or deleted by the manufacturer and/or the customer for the application desired. The invention eliminates special manufacturing sequences, steps and scheduling, and achieves significant cost reduction through such universal application.

BRIEF DESCRIPTION OF THE DRAWINGS

FIG. 9 is an enlarged view of a portion of FIG. 3.

FIG. 10 is an enlarged view of a portion of FIG. 5.

FIG. 11 is like FIG. 10 but shows further downward pivoting.

FIG. 12 is like FIG. 6 but shows further upward pivoting.

DETAILED DESCRIPTION

Figure 1:
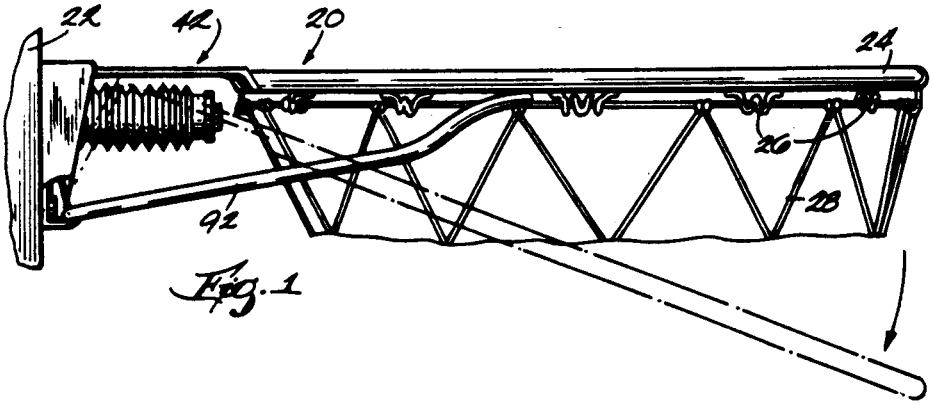
FIG. 1 shows a breakaway basketball goal assembly constructed in accordance with the invention.
Figure 2:
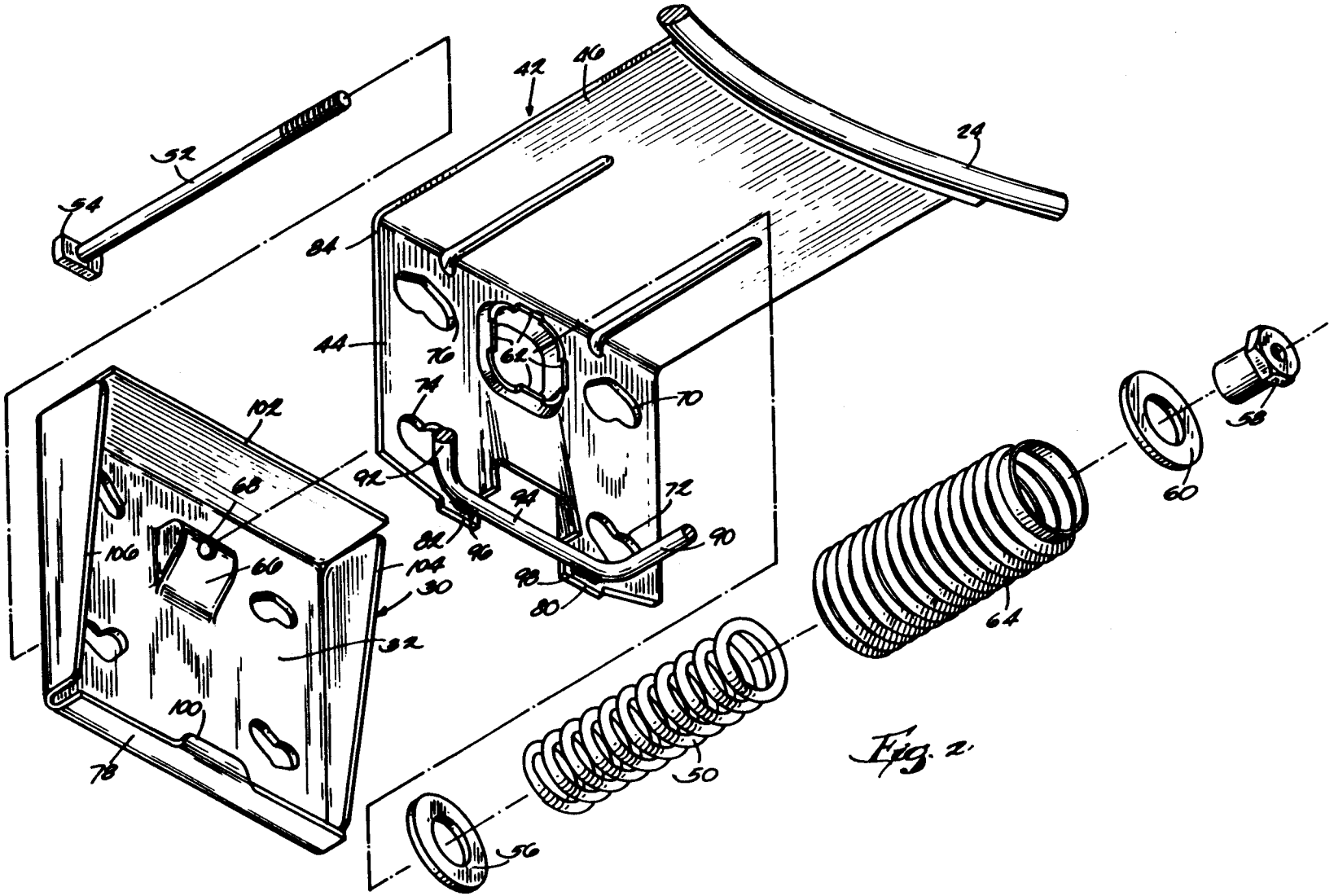
FIG. 2 is an exploded perspective view of portions of the structure of FIG. 1.

FIG. 1 shows a breakaway basketball goal assembly 20 for mounting to a backboard 22. The assembly includes a basketball goal rim 24 having a plurality of rams 26 for holding net 28. A rear mounting plate 30, FIGS. 2 and 3, includes a generally flat planar backplate portion 32 for stationary mounting to the front of backboard 22 by bolts 34, 36, 38, 40, FIG. 4. A forward mounting plate 42, FIGS. 2 and 3, is provided by a generally inverted L-shaped member having a vertical leg 44 extending along the front of backplate portion 32 of mounting plate 30, and having a generally horizontal leg 46 extending forwardly from the top of vertical leg 44 and rigidly connected to rim 24 at weldment 48.

Figure 3:
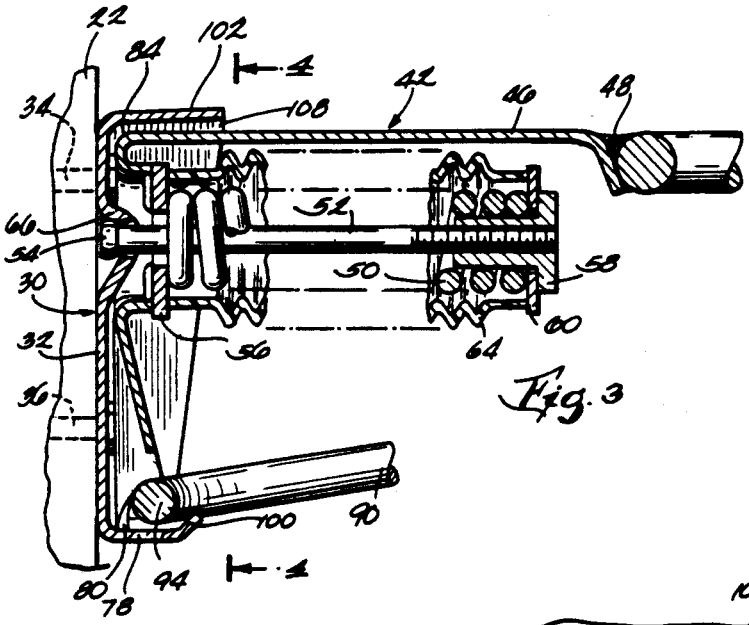
FIG. 3 is a side sectional view of a portion of the structure of FIG. 1.
Figure 4:
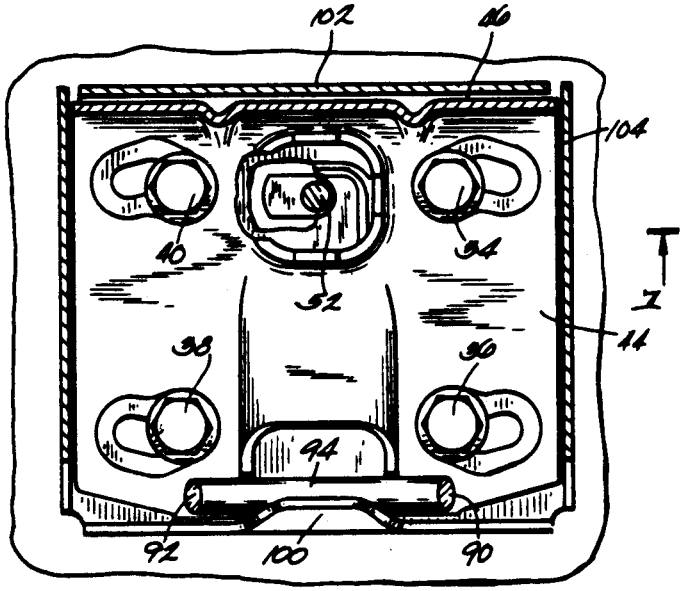
FIG. 4 is a sectional view taken along line 4—4 of FIG. 3.

Compression spring 50 biases mounting plates 30 and 42 towards each other such that rim 24 is biased to a normally horizontal position, FIGS. 1 and 3. A horizontal stud 52 has its rearward end 54 formed with a T-shape or crossbar retained by mounting plate 30 and encircled by compression spring 50 bearing between vertical leg 44 of mounting plate 42 at washer 56 and a retainer nut 58 and washer 60 on the forward end of stud 52. The forward end of stud 52 is threaded and receives threaded nut 58, which provides user adjustable control of the compression of spring 50, which in turn controls the breakaway force. Spring 50 is compressed between washers 56 and 60. Washer 56 is stopped against seats 62 on vertical leg 44. A plastic bellows 64 is provided around spring 50 between washers 56 and 60 to provide a flexible expansible cover for the spring and to protect the players. Flat planar backplate portion 32 of rear mounting plate 30 has a forwardly extending humped anchor or boss portion 66 with an aperture 68 therethrough receiving stud 52 and anchoring the rearward end 54 of the stud. Spring 50 is further compressed during pivoting of front mounting plate 42 away from rear mounting plate 30, to be described. Vertical leg 44 of mounting bracket 42 has clearance holes 70, 72, 74, 76 which are larger than the heads of respective bolts 34, 36, 38, 40, to allow clearance for pivoting of vertical leg 44 toward and away from vertical backplate portion 32.

Rear mounting plate 30 has a lower guide tray portion 78 extending forwardly from the backboard. Vertical leg 44 of mounting plate 42 has a lower pivot including lower legs 80 and 82, FIG. 2, received in lower guide tray portion 78 and translatable forwardly and rearwardly therealong to provide a translational pivot. Rim 24 has a downwardly pivoted position, FIGS. 5 and 10, responsive to a downward force on the rim, wherein the lower pivot 80, 82 of vertical leg 44 of mounting plate 42 is translated rearwardly along lower guide tray portion 78 of mounting plate 30. Rim 24 has an upwardly pivoted position, FIG. 6, responsive to an upward force on the rim, wherein lower pivot 80, 82 of mounting plate 42 is translated forwardly along lower guide tray portion 78 of mounting plate 30.

Figure 6:
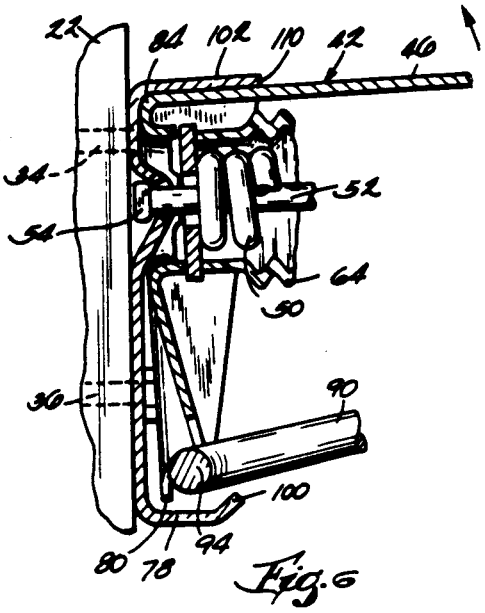
FIG. 6 is a view like FIG. 3 but showing an upwardly pivoted condition.

Vertical leg 44 of mounting plate 42 has an upper pivot 84 pivoting about backplate portion 32 of mounting plate 30 when rim 24 is pivoted to an upwardly pivoted position, FIG. 6. Upper pivot 84 moves forwardly away from backplate portion 32 when rim 24 is pivoted to its downwardly pivoted position. Biasing spring 50 yields in response to a given downward threshold force on rim 24 to permit pivoting of the rim to its downwardly pivoted position, with upper pivot 84 moving forwardly, and lower pivot 80, 82 translated to the rear of lower guide tray portion 78. Biasing spring 50 yields in response to a given upward threshold force on rim 24 to permit pivoting of the rim to its upwardly pivoted position, with lower pivot 80, 82 translated forwardly along lower guide tray portion 78.

The noted given upward threshold force is less than the noted given downward threshold force because of the different length lever arms between spring 50 and the respective pivot points. The lever arm between upper pivot 84 and spring 50 is shorter than the lever arm between lower pivot 80, 82 and spring 50. This difference in length of lever arms provides the noted differential breakaway forces, to provide differential up and down breakaway.

Figure 7:
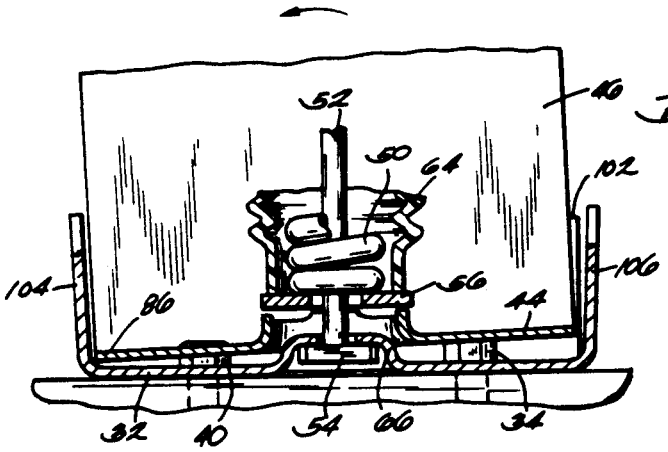
FIG. 7 is a sectional view taken along line 7—7 of FIG. 4 but showing a leftwardly pivoted position.
Figure 8:
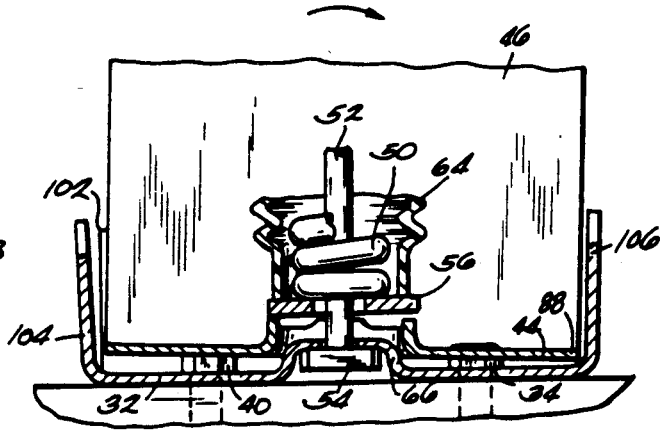
FIG. 8 is a view like FIG. 7 but showing a rightwardly pivoted condition.

Rim 24 also has a leftwardly pivoted position, FIG. 7, in each of the horizontal and upwardly and downwardly pivoted positions responsive to a leftward force on the rim. Rim 24 also has a rightwardly pivoted position, FIG. 8, in each of the horizontal and upwardly and downwardly pivoted positions responsive to a rightward force on the rim. Biasing spring 50 yields in response to a given leftward threshold force on the rim to permit pivoting of the rim about pivot 86 to its leftwardly pivoted position. Biasing spring 50 yields in response to a given rightward threshold force on the rim to permit pivoting of the rim about pivot 88 to its rightwardly pivoted position. The leftward and rightward threshold breakaway forces are the same because the length of the lever arms between spring 50 and pivots 86 and 88 are the same. The leftward and rightward breakaway force is greater than the upward breakaway force but less than the downward breakaway force because the lever arm between spring 50 and pivot 86 or 88 is longer than the lever arm between spring 50 and upper pivot 84, and is shorter than the lever arm between spring 50 and lower pivot 80, 82.

Rim 24 has a pair of support bars 90, 92 extending downwardly and rearwardly from opposite undersides of rim 24 and joined at a central support bar 94 rigidly connected to vertical leg 44 of mounting plate 42 at weldments 96, 98. Lower guide tray portion 78 of mounting plate 30 has a central upwardly turned flange 100 at the forward end thereof. Lower feet 80 and 82 are spaced along central support bar 94 on opposite right and left sides of flange 100.

Spring 50 biases rearward stud end 54 forwardly such that end 54 exerts a forward force on humped anchor portion 66. Downward pivoting of the rim further compresses spring 50 and increases the forward force exerted by stud end 54 on anchor portion 66, which in turn may cause backplate portion 32 of rear mounting plate 30 to bow forwardly away from backboard 22. Mounting plate 30 includes a generally horizontally planar upper extension portion 102 at the top of backplate portion 32 and integrally extending forwardly therefrom above horizontal leg 46 of forward mounting plate 42. Portion 102 is proximate humped portion 66 and provides a forwardly extending structural rib strengthening backplate portion 32 against bowing away from the backboard. Extension portion 102 additionally serves the function of covering the gap between backplate portion 32 and vertical leg 44 of mounting plate 42 when the rim is pivoted downwardly, to protect the fingers of the players. Mounting plate 30 further includes right and left walls 104 and 106 integrally extending forwardly from backplate portion 32 and spaced by vertical leg 44 therebetween and also covering the gap between backplate portion 32 and vertical leg 44 when the rim is pivoted downwardly. Rear mounting plate 30 thus provides all of the above noted functions and additionally provides the function of preventing a player from pinching his fingers in the noted gap, without a separate additional pinch gap shroud such as 60 in incorporated U.S. Pat. No. 4,583,732.

Figure 5:
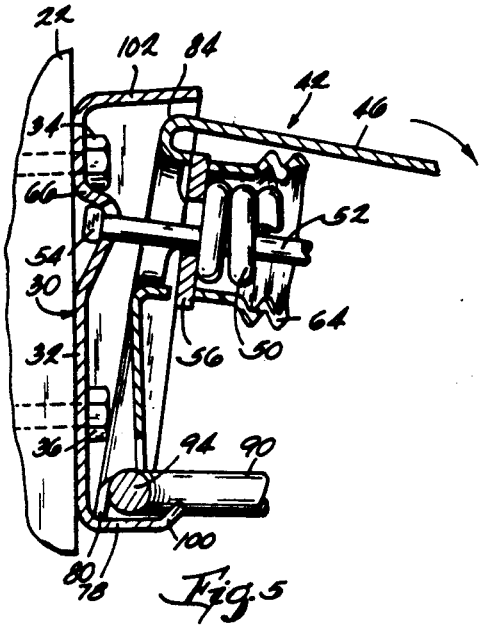
FIG. 5 is a view like FIG. 3 but showing a downwardly pivoted condition.

When rim 24 is in the downwardly pivoted position shown in FIGS. 5 and 10, feet 80, 82 are stopped against the lower end of backplate portion 32 at the rear of lower guide tray portion 78. Rim 24 has a further downwardly pivoted position as shown in FIG. 11 in which the pair of support bars 90 and 92 move downwardly past central upwardly turned flange 100 therebetween, and in which feet 80, 82 translate upwardly along backplate portion 32 of mounting plate 30.

In the upwardly pivoted position of rim 24 as shown in FIG. 6, central support bar 94 is translated partially forwardly along lower guide tray portion 78 and is spaced rearwardly of central upwardly turned flange 100. Upward pivoting of rim 24 to the position shown in FIG. 6 closes the gap 108, FIG. 3, between horizontal leg 46 of mounting plate 42 and extension portion 102 of mounting plate 30. Rim 24 has a further upwardly pivoted position as shown in FIG. 12 in which horizontal leg 46 of mounting plate 42 engages and pivots about the forward end 110 of upper extension portion 102 of mounting plate 30, and central support bar 94 translates further forwardly and is stopped against central upwardly turned flange 100, and pivot 84 translates downwardly along backplate portion 32 of mounting plate 30.

The disclosed structure also provides a universal basketball goal assembly for mounting to a backboard and selectively providing a choice between a breakaway basketball goal and a non-breakaway basketball goal without changing the manufacturing operation producing the goal assembly. Mounting plate 30 and the biasing means including spring 50 and stud 52 are omitted in applications where a non-breakaway basketball assembly is desired. In such application, vertical leg 44 of mounting plate 42 is stationarily mounted to backboard 22.

It is recognized that various equivalents, alternatives and modifications are possible within the scope of the appended claims.

I claim:

1. A breakaway basketball goal assembly for mounting to a backboard comprising a basketball goal rim, a first mounting plate comprising a generally vertical plate for stationary mounting to the front of said backboard, a second mounting plate including a generally inverted L-shaped member having a vertical leg extending along the front of said first mounting plate and having a generally horizontal leg extending forwardly from said vertical leg and rigidly connected to said rim, biasing means biasing said first and second mounting plates towards each other such that said rim is biased to a normally horizontal position, said first mounting plate having a lower guide tray portion extending forwardly, said vertical leg of said second mounting plate having a lower pivot received in said lower guide tray portion and translatable forwardly and rearwardly therealong to provide a translational pivot, said rim having a forwardly pivoted position responsive to a downward force to said rim, said lower pivot of said second mounting plate being translatable rearwardly along said lower guide tray portion of said first mounting plate, said rim having an upwardly pivoted position responsive to an upward force on said rim, with said lower pivot portion of said second mounting plate being translated forwardly along said lower guide tray portion of said first mounting plate, wherein said rim has a pair of support bars extending downwardly and rearwardly from opposite undersides of said rim and joined at a central support bar rigidly connected to said vertical leg of said second mounting plate, and wherein said lower guide tray portion of said first mounting plate has a central upwardly turned flange of the outer end thereof, and wherein said vertical leg of said second mounting plate has a pair of lower feet spaced along said central support bar on opposite right and left sides of said central upwardly turned flange of said lower guide tray portion of said first mounting plate, said feet translating forwardly and rearwardly through said guide tray portion of said first mounting plate during said pivoting of said rim.

2. The invention according to claim 1 wherein said feet are stopped against said first mounting plate at the rear of said lower guide tray portion when said rim is in said downwardly pivoted position, and wherein said rim has a further downwardly pivoted position in which said pair of support bars move downwardly past said central upwardly turned flange therebetween and in which said feet translate upwardly along said first mounting plate.

3. The invention according to claim 2 wherein said first mounting plate has an upper extension portion extending forwardly above said horizontal leg of said second mounting plate, and wherein said central support bar is translated partially forwardly along said lower guide tray portion and is spaced rearwardly of said central upwardly turned flange when said rim is in said upwardly pivoted position, said vertical leg of said second mounting plate having an upper pivot pivoting about said first mounting plate, and wherein said rim has a further upwardly pivoted position in which said horizontal leg of said second mounting plate engages and pivots about the forward end of said upper extension portion of said first mounting plate and in which said central support bar translates further forwardly and is stopped against said central upwardly turned flange and in which said upper pivot of said vertical leg of said second mounting plate translates downwardly along said first mounting plate.

4. A breakaway basketball goal assembly for mounting to a backboard comprising a basketball goal rim, a first mounting plate comprising a generally vertical plate for stationary mounting to the front of said backboard, a second mounting plate including a generally inverted L-shaped member having a vertical leg extending along the front of said first mounting plate and having a generally horizontal leg extending forwardly from said vertical leg and rigidly connected to said rim, biasing means biasing said first and second mounting plates towards each other such that said rim is biased to a normally horizontal position, said first mounting plate having a lower guide tray portion extending forwardly, said vertical leg of said mounting plate having a lower pivot received in said lower guide tray portion and translatable forwardly and rearwardly therealong to provide a translational pivot, said rim having a downwardly pivoted position responsive to a downward force on said rim, with said lower pivot of said second mounting plate being translated rearwardly along said lower guide tray portion of said first mounting plate, said rim having an upwardly pivoted position responsive to an upward force on said rim, with said lower pivot portion of said second mounting plate being translated forwardly along said lower guide tray portion of said first mounting plate, wherein said biasing means comprises a generally horizontal stud having one end retained by said first mounting plate and encircled by a compression spring bearing and compressed between said vertical leg of said second mounting plate and a retainer on the other end of said stud, such that pivoting of said second mounting plate away from said first mounting plate about said lower pivot of said vertical leg of said second mounting plate further compresses said spring when the downward force on said rim is greater than said downward threshold force, and wherein said first mounting plate comprises a generally flat planar back plate portion having a forwardly extending humped anchor portion with an aperture therethrough receiving said stud and anchoring said one end of said stud, wherein said spring biases said one end of said stud forwardly such that said one end of said stud exerts a forward force on said humped anchor portion, and wherein said further compression of said ring during said downward pivoting of said rim increases the forward force exerted by said one end of said stud on said anchor portion which in turn may cause said generally flat planar back plate portion of said first mounting plate to bow forwardly away from said back board, said first mounting plate further comprising a forwardly extending structural rib proximate said humped anchor portion and strengthening said back plate portion against said bowing away from said back board, and wherein said structural rib is at the top of said back plate portion of said first mounting plate and is a generally horizontally planar extension portion and extends forwardly above said second mounting plate and additionally serves the function of covering the gap between said back plate portion of said first mounting plate and said vertical leg of said second mounting plate when said rim is in said downwardly pivoted position, and wherein said first mounting plate further includes right and left walls extending forwardly from said back plate portion and spaced by said vertical leg of said second mounting plate therebetween and also covering the gap between said back plate portion of said first mounting plate and said vertical leg of said second mounting plate when said rim is in said downwardly pivoted position.

5. A breakaway basketball goal comprising a forward mounting plate including a vertical portion and an upper portion extending horizontally from the vertical portion and having a forward edge, a rearward mounting plate adapted to be fixed to a backboard and having extending generally horizontally therefrom an upper portion adjacent and over the upper portion of the forward mounting plate, mounting means for supporting the forward mounting plate on the rearward mounting plate for pivotal movement relative thereto, the mounting means affording pivotal movement of the forward mounting plate relative to the rear mounting plate between a first, undeflected position and a second, upwardly deflected position by rotation about a first pivot defined by engagement between the upper edge of the vertical portion of the forward mounting plate and the upper portion of the rearward mounting plate, affording pivotal movement of the forward mounting plate relative to the rearward mounting plate between the second position and a third, upwardly deflected position about a second pivot defined by engagement between the upper portion of the forward mounting plate and the forward edge of the upper portion of the rearward mounting plate, and affording pivotal movement of the forward mounting plate relative to the rearward mounting plate between the undeflected position and a downwardly pivoted position, and the mounting means including means for biasing the forward mounting plate towards the undeflected position.

* * * * *